US006472828B1

(12) United States Patent
Pruett et al.

(10) Patent No.: US 6,472,828 B1
(45) Date of Patent: Oct. 29, 2002

(54) CONTROL FOR PROJECTOR LAMP HEAT DISSIPATION

(75) Inventors: Henry Frazier Pruett, Sandy; Fred Parker; Roger Yaffe, both of Sherwood; Jeff Gohman, Hillsboro; Cathy Biber, Tigard, all of OR (US)

(73) Assignee: InFocus Corporation, Wilsonville, OR (US)

( * ) Notice: Subject to any disclaimer, the term of this patent is extended or adjusted under 35 U.S.C. 154(b) by 0 days.

(21) Appl. No.: 09/602,348

(22) Filed: Jun. 23, 2000

(51) Int. Cl.[7] ..... H05B 37/02

(52) U.S. Cl. ..... 315/225; 315/149; 315/309; 361/678; 361/690; 362/373; 353/52; 353/85

(58) Field of Search ..... 315/225, 149, 315/200 R, 307, 309; 361/676, 678, 688, 690; 362/373; 353/52, 57, 85, 119, 121

(56) References Cited

U.S. PATENT DOCUMENTS 5,014,225 A * 5/1991 Vidaver et al. ..... 364/550
5,340,108 A * 8/1994 Gerpheide et al. ..... 273/185 A
5,758,956 A * 6/1998 Bornhorst et al. ..... 362/294
6,203,158 B1 * 3/2001 Furuhata et al. ..... 353/31

* cited by examiner

*Primary Examiner*—David Vu
*Assistant Examiner*—Thuy Vinh Tran
(74) *Attorney, Agent, or Firm*—Stoel Rives LLP

(57) ABSTRACT

A portable image projector is provided with a fan having a control system for cooling a metal-halide arc lamp. The arc lamp cooling system of the present invention includes a fan having a fan control to operate the fan at an initially reduced level during lamp start-up to allow the temperature of the arc lamp to increase to its full operating temperature. The fan control includes a microcontroller to operate the fan at a reduced voltage over a period of time after which the voltage is increased to operate the fan at full capacity. Power to the fan may be increased in incremental time steps or linearly over a period of time as determined by the microcontroller.

10 Claims, 4 Drawing Sheets

CONTROL FOR PROJECTOR LAMP HEAT DISSIPATION

TECHNICAL FIELD

This invention is directed to a cooling device for controlling the temperature of a projection lamp in an image projector and, more particularly, to a control for the cooling device.

BACKGROUND OF THE INVENTION

Portable image projectors are becoming more popular and desirable. Some of the portable projectors are small enough and light enough to be carried by one hand and are generally referred to as "ultra-portable." The image projector typically includes a lamp module removably housed inside the image projector. Some of these portable image projectors may include a lamp module that uses a metal-halide arc lamp which operates at a very high temperature and requires a high voltage pulse to ignite the arc. The arc lamp may be part of a lamp module unit. These portable projectors must be compact and lightweight, and must be packaged to protect users and the projector from heat, high voltage, and improper operating modes, such as operation of equipment at excessive temperatures, and high-voltage pulse generation during arc lamp replacement. In particular, the compactness of the units combined with the high temperatures of the high intensity lamps make controlling the heat produced by the arc lamps very important.

The arc lamp operates at a low temperature during an initial start-up period and, after the arc is established, gradually warms up to its full operating temperature. Initially, a high voltage pulse is applied to the lamp to establish the arc across the electrodes. The power to the supplied to the lamp is low at this point in order to prevent damage to the electrodes. Ignition of the arc establishes a voltage across the lamp and a carrier gas contained within the lamp is ionized. At this initial start-up stage the temperature of the arc lamp is low. However, the temperature of the arc lamp increases as the gas is ionized and as the lamp warms up power to the lamp is gradually increased. When all of the gas has been ionized the lamp is operating at its brightest capacity and highest temperature.

One method of controlling the heat produced by the arc lamp is to provide a fan to blow cool air over and past the arc lamp. However, a common problem is that the fan may prevent the arc lamp from reaching its full operating temperature by cooling it too much during the lamp start-up period. Typically, the arc lamp and the fan are started simultaneously. The fan operates at full capacity even during the start up period when the arc lamp is operating at a reduced capacity. Operation of the fan at full capacity can delay or may even prevent the arc lamp from reaching its full operating temperature because the cooling effect of the fan is too great. Therefore, it is desirable to control the fan so that it operates at a reduced capacity during the lamp start-up period to allow the arc lamp to reach its full operating temperature.

SUMMARY OF THE INVENTION

It is an object of the present invention to provide an arc lamp cooling system that allows the arc lamp to reach its full operating temperature.

It is another object of the present invention to provide a fan control to reduce the cooling effect of the fan during initial start up of the arc lamp.

It is a further object of the present invention to provide a fan control that prevents erratic run-up of the arc lamp.

A portable image projector is provided with a fan having a control system for cooling a metal-halide arc lamp which operates at a very high temperature. Since such portable image projectors are so compact controlling the heat produced by the arc lamps very important, especially during lamp start-up.

The arc lamp cooling system of the present invention includes a fan control to drive the fan at an initially reduced level to allow the temperature of the arc lamp to increase to its full operating temperature after which the fan voltage is increased to its full operating capacity. The fan control includes a microcontroller which is run by software to operate the fan at a reduced voltage over a period of time after which the voltage is increased to operate the fan at full capacity. The voltage at which the fan operates depends upon the temperature of the air at the air intake on as measured by a sensor. The software determines the fan start-up voltage and monitors the time period or periods to increase the fan voltage as a function of the temperature of the air. Power to the fan may be increased in incremental time steps or linearly over a period of time as determined by the microcontroller.

Additional objects and advantages of this invention will be apparent from the following detailed description of preferred embodiments thereof which proceeds with reference to the accompanying drawings.

DETAILED DESCRIPTION OF PREFERRED EMBODIMENT

Figure 1:
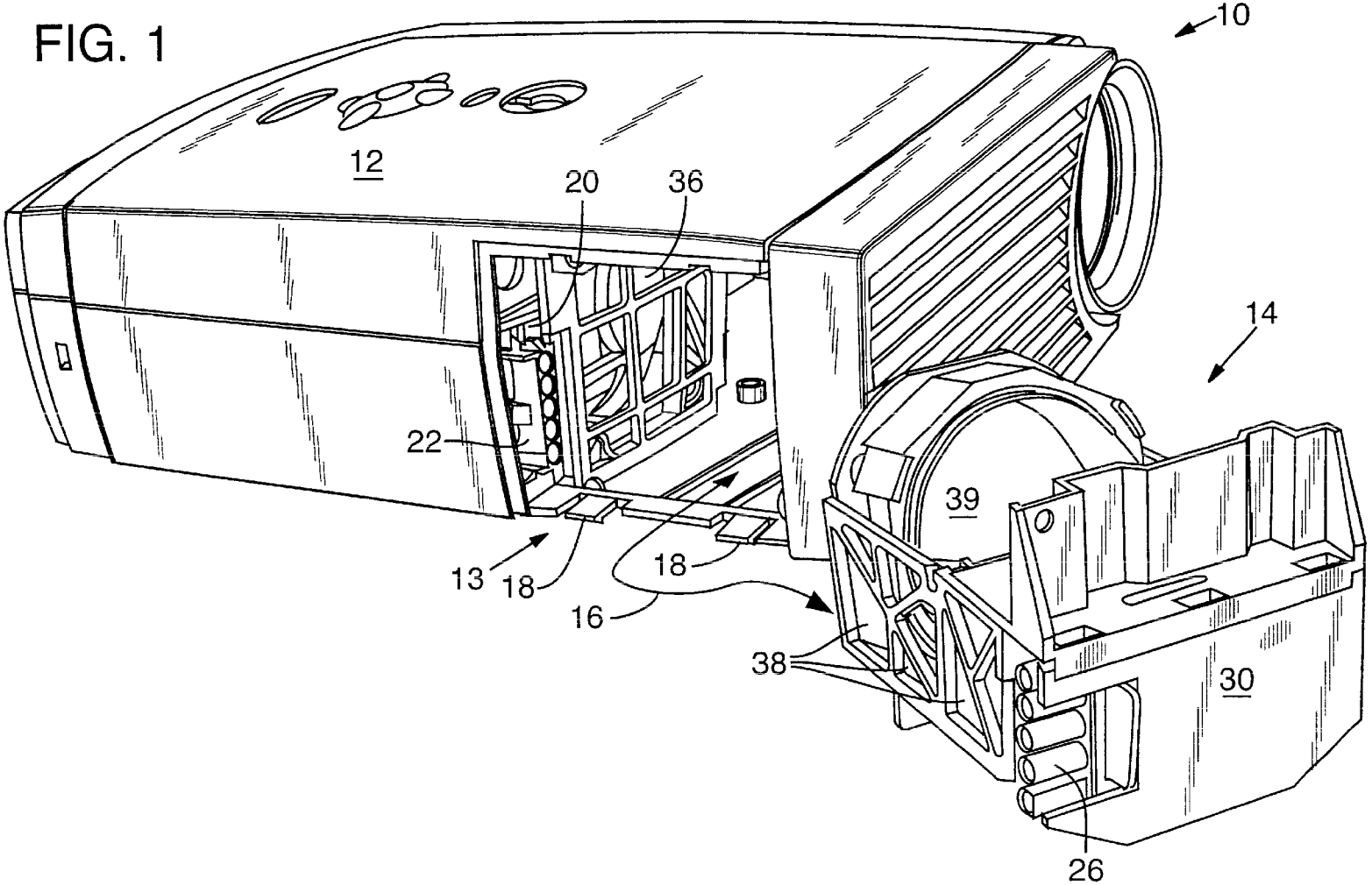
FIG. 1 is an isometric view of an image projector of the type employing the present invention in showing a fan located within the projector enclosure and a lamp module removed from the projector enclosure.

FIG. 1 shows an image projector 10 of the type for use in the present invention; however, it is understood that the present invention may be employed in a variety of image projectors. The image projector 10 is housed in an enclosure 12 having a cavity 13 into which a lamp module 14 is located. The lamp module 14 may be slidably removed or inserted along a directional path generally indicated by an arrow 16. When fully inserted into cavity 13, lamp module 14 may be covered by an access panel (not shown) that snaps into place and is secured to enclosure 12 by a pair of cantilevered snap latches 18.

Cavity 13 is sized to mate with lamp module 14, thereby properly aligning and positioning the lamp module 14 as it slides into or out of cavity 13. Projector 10 includes adjacent to cavity 13 a side wall 20, to which is fixedly mounted a female half 22 of a mating five-pin connector pair 24 (FIG. 5) (hereafter "connector 24"). Whereas lamp module 14 includes an outer shell 30 within which is slidably mounted a male half 26 of connector 24. Easy user assess to male half 26 of connector 24 is ensured by mounting it on or adjacent to outer shell 30 of lamp module 14. Lamp module 14 slides into enclosure 12 along a first direction defined by cavity 13, whereas female and male halves 22 and 26 of connector 24 slidably engage together in a second direction that is preferably transverse to the first direction. Female and male halves 22 and 26 of connector 24 are preferably respective part No. 350810-1 and 350809-1 manufactured by AMP, Inc., Harrisburg, Pa.

Figure 2:
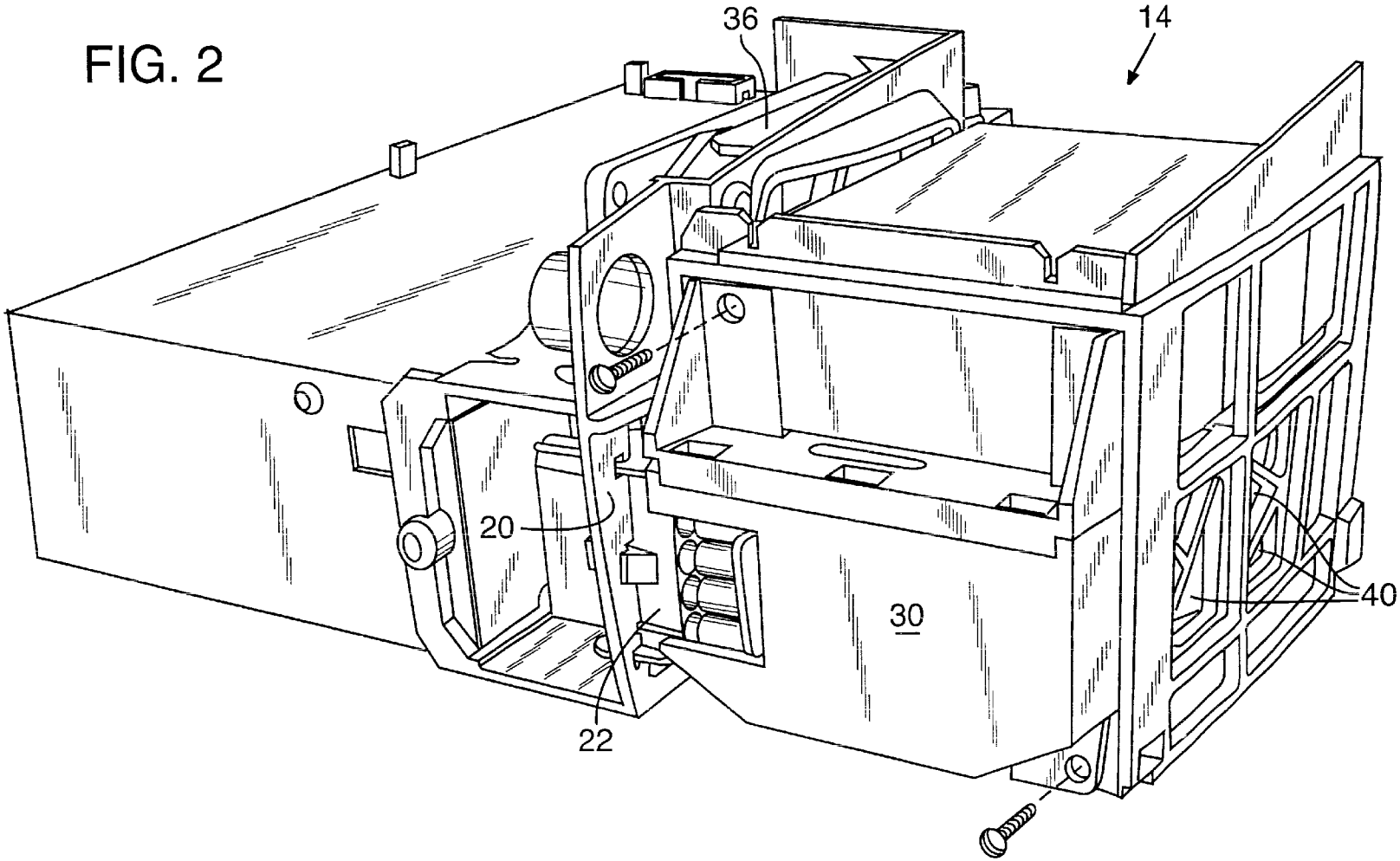
FIG. 2 is an isometric view of internal components of the image projector of FIG. 1 showing the lamp module operatively positioned in the projector within a lamp frame mounted adjacent to a power supply and a cool fan.

FIG. 1 further shows a cooling fan 36 mounted on an opening in and from the opposite surface of side wall 20 to direct airflow toward air inlets 38 on lamp module 14. Air flows generally in the second direction through lamp module 14, across an arc lamp 39, and exhausts through air outlets 40 (FIG. 2). Also mounted adjacent to the opposite surface of side wall 20 is a housing 42 enclosing electrical components that are described with reference to FIG. 3.

Figure 3:
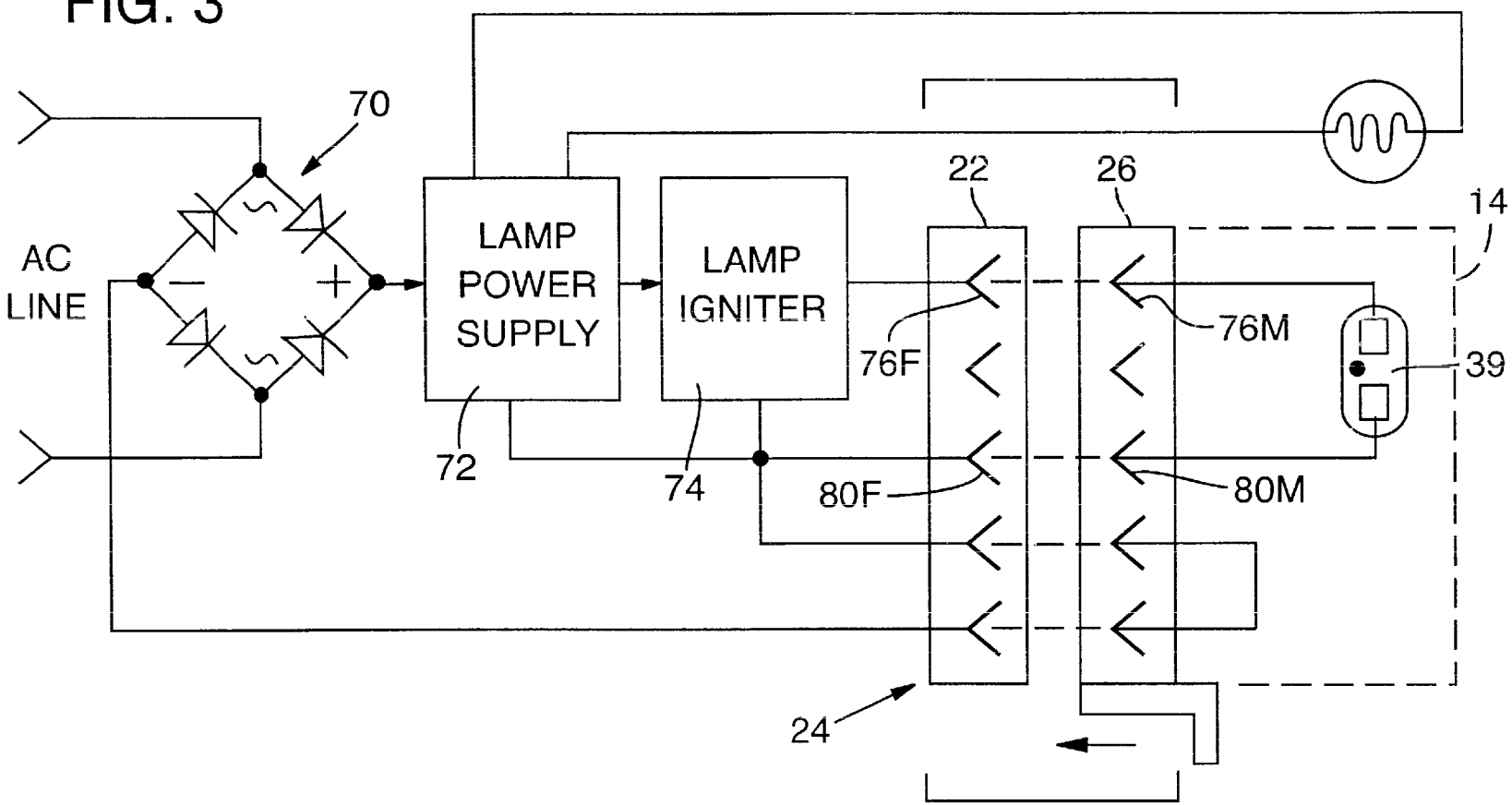
FIG. 3 is an electrical schematic diagram showing a preferred embodiment of a safety interlocking lamp interconnect circuit.

FIG. 3 shows how connector 24 also performs electrical interconnect and safety interlock functions for projector 10. A bridge rectifier 70 receives alternating current line power and provides positive direct current ("DC") voltage to a lamp power supply 72, which generates a ballasted 30 to 50 volts DC lamp voltage that is looped through a lamp igniter circuit 74 and electrically connected to a contact 76F ("F" indicates female) in female half 22 of a connector 24. A contact 76M ("M" indicates male) in male half 26 of connector 24 mates to contact 76F and is electrically connected to arc lamp 39 that is mounted within lamp module 14. Arc lamp 39 is preferably a 270-watt, metal-halide arc lamp, although arc lamps dissipating less than about 300 watts are suitable for use in portable projectors. The circuit from arc lamp 39 is completed to lamp power supply 72 and lamp igniter circuit 74 through a mating pair of contacts 80F and 80M in connector 24. A thermal sensor or circuit breaker 81 deactivates lamp power supply 72 if the temperature adjacent to lamp module 14 exceeds a predetermined limit.

Lamp igniter circuit 74 generates greater than 10,000 volt pulses, preferably 20,000 volt pulses, during the ignition of arc lamp 39. Therefore, connector 24 must be insulated to withstand the voltage required to ignite arc lamp 39 and also be rated to carry the 30 to 50 volts DC at about 9 amperes required to power arc lamp 39 after it is ignited. The preferred connector is of a coaxial pin housing type that fully encloses the male and female pins inserted into female and male halves 22 and 26 and does, therefore, meet the above-stated insulation and rating requirements.

The arc lamp 39 is started by the lamp igniter circuit 74 which provides a high voltage pulse to the arc lamp 39. Once the arc is established the gas in the arc lamp 39 begins to ionize and as gas ionization continues the arc voltage gradually increases along with the temperature until the arc lamp 39 reaches its full operating temperature. It may take up to two minutes for the arc lamp 39 to reach its full operating temperature. During this initial start-up period power supplied to the arc lamp 39 is low to prevent damage to the electrodes in the arc lamp 39. As the temperature of the arc lamp 39 increases it draws more current from the lamp power supply 72. The lamp power supply 72 provides a constant current to the arc lamp 39 once the full operating temperature of the arc lamp 39 is reached.

The fan 36 is started simultaneously with the ignition of the arc lamp 39 and is operated through a fan control 90 which varies the voltage at which the fan 36 operates over time. The fan 36 operates at a reduced voltage during the initial lamp start-up period to allow the arc lamp 39 to warm up to its full operating temperature. When the arc lamp 39 reaches its full operating temperature the fan control 90 increases the voltage to the fan 36 so that it operates at full capacity. The initial lamp start-up period may be, for example, about two minutes. After this period voltage to the fan 36 gradually increases, either linearly or in a step-wise manner, until the fan 36 operates at full capacity. Thus, the fan control 90 varies the fan output over time. It is understood that a variety of fans may be employed in the present invention which may be controlled by various methods and that the following description is a preferred embodiment.

Figure 4:
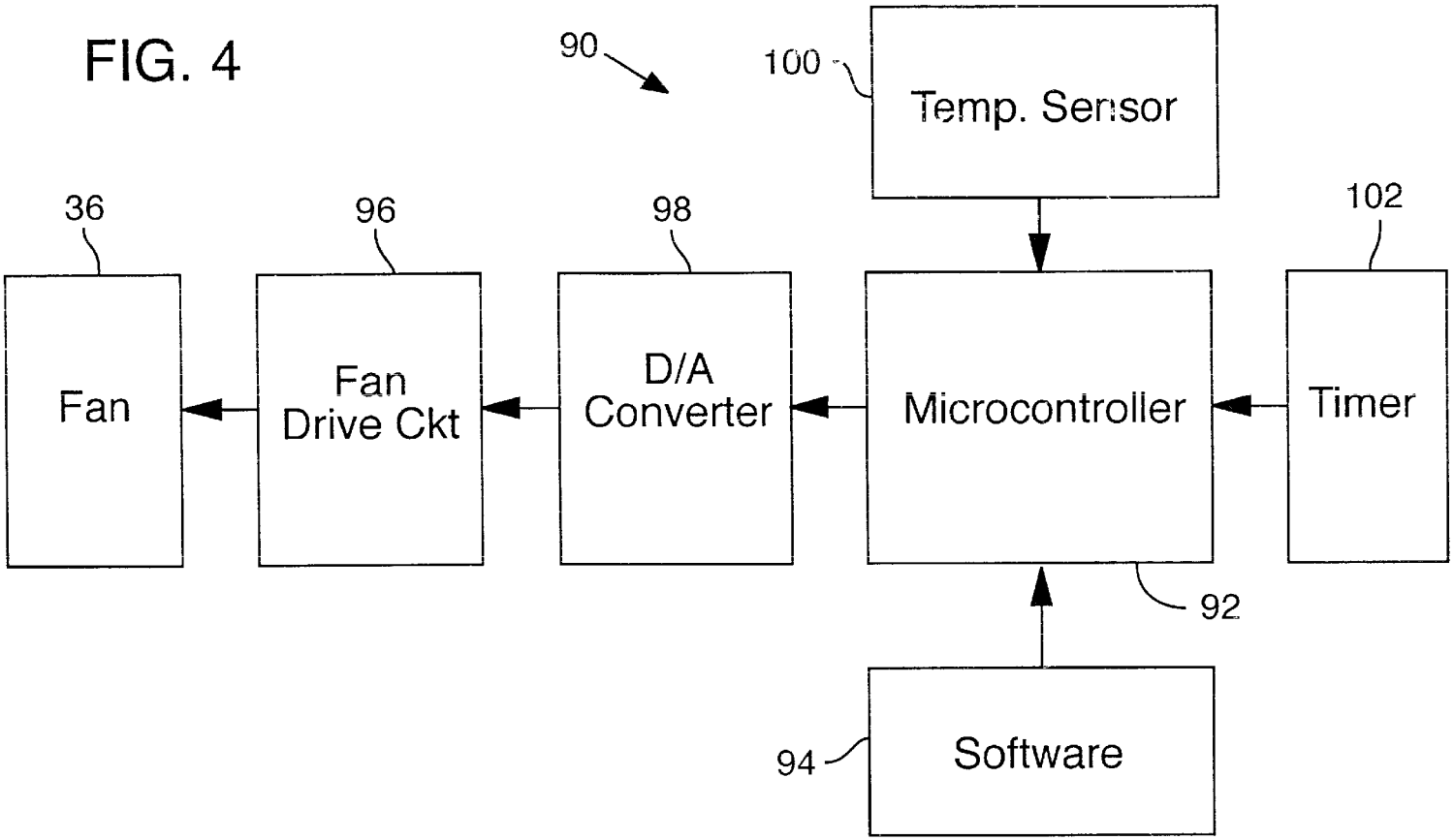
FIG. 4 is a block diagram of the fan control of the present invention.

Referring now to FIG. 4, the fan control 90 is shown for controlling the fan 36 in accordance with the present invention by operating the fan 36 at an initially reduced voltage for a pre-selected period of time after which voltage is increased until the fan 36 operates at full capacity. The preferred fan control 90 includes a microcontroller 92 that is preferably driven by software 94 to control the voltage to the fan 36 so that the fan output increases over a period of time. The microcontroller 92 controls the fan 36 through a fan drive circuit 96 and a D/A converter 98. A temperature sensor 100 is provided to determine the air temperature at the air intake in order to determine the start-up voltage of the fan 36. It is preferred that the fan 36 operate at a capacity to provide initial cooling to the arc lamp 39 but not at such a capacity that it creates significant noise. The microcontroller 92 includes a timer 102 that sets the time period or periods over which the fan voltage varies. The fan voltage may be increased in a step-wise manner or linearly.

In the preferred embodiment a 9 volt fan is employed to cool the arc lamp 39. After the arc has been ignited the temperature sensor 100 measures the air temperature at the air intake so that the microcontroller 92 determines the initial fan voltage. Typically, the fan operates on about 5 or 6 volts during the lamp start-up period. The initial output of the fan 36 is enough to initially cool the arc lamp 39 but not create too much noise. As the gas within the arc lamp 39 begins to ionize the arc lamp 39 warms up. The temperature of the arc lamp 39 continues to increase until substantially all of the gas is ionized at which point the arc lamp 39 reaches its full operating temperature. The lamp start-up period may vary depending of various characteristics of the arc lamp 39. The time period during which the fan 36 operates at a reduced voltage is determined by the timer 102 which is set to approximately correspond to the lamp startup period. For example, the lamp start-up period may be about two minutes. Thus, the microcontroller 92 controls the voltage to the fan 36 so that it operates on about 5 or 6 volts for about two minutes after which the voltage is stepped up to about 9 volts so that the fan 36 is operating at full capacity.

The microcontroller 92 may increase the fan voltage in other ways, such as, by gradually stepping up the voltage during the lamp start-up period so that the fan 36 is operating at full capacity at the end of the lamp start-up period. For example, the microcontroller 92 may increase the fan voltage over small increments of time, such as, for example, every 15 or 30 seconds during the lamp start-up period. Alternatively, the microcontroller 92 may gradually continuously increase the fan voltage during the lamp start-up period instead of increasing the fan voltage incrementally. Thus, it can be seen that the fan 36 can be controlled in a variety of ways as long as the fan output is kept to a minimum during the lamp start-up period to allow the arc lamp 39 to heat up to its fill operating temperature.

It will be obvious to those having skill in the art that many changes may be made to the details of the above-described embodiment of this invention without departing from the underlying principles thereof. The scope of the present invention should, therefore, be determined only by the following claims.

What is claimed is:

1. An image projection system for a display device including a light source enclosed within a housing, the light source including an arc lamp for producing a high intensity illumination beam, wherein the arc lamp draws reduced power during ignition after which the arc lamp draws increased power until at completion of an initial start-up period the arc lamp reaches a full operating intensity, comprising:

a cooling system that includes a fan that provides an operating output for cooling the arc lamp;

a power supply for supplying voltage to drive the fan; and a controller operatively connected to the power supply and the fan to control the operating output of the fan during the initial start-up period.

2. The image projection system of claim 1, wherein the initial start-up period is about two minutes or less.

3. The image projection system of claim 1, further including a temperature sensor for monitoring a temperature of the air inside the housing so that the controller causes the fan operating output to vary depending on the temperature of the air inside the housing.

4. The image projection system of claim 3, wherein the controller causes voltage to the fan to increase as the air temperature increases.

5. The image projection system of claim 1, wherein the arc lamp is a metal-halide arc lamp.

6. The image projection system of claim 3, in which the controller determines a fan start-up voltage so that the fan operates at a first operating output for a period of time that substantially corresponds to the initial start-up period and increases voltage to the fan as a function of the temperature of the air.

7. In an image projection system for a display device including a light source enclosed within a housing, the light source including an arc lamp for producing a high intensity illumination beam, wherein the arc lamp draws reduced power during ignition after which the arc lamp draws increased power until at completion of an initial start-up period the arc lamp reaches a full operating intensity, a method of cooling the arc lamp, comprising:

providing a fan to blow a cooling stream of air across the arc lamp;

driving the fan at a reduced output during the arc lamp start-up period; and increasing the fan output as the arc lamp reaches its full operating intensity.

8. The method of claim 7, wherein an air temperature within the housing increases as the arc lamp reaches its full operating intensity, the method further comprising varying the fan output depending on the air temperature.

9. The method of claim 7, wherein an air temperature within the housing increases as the arc lamp reaches its full operating intensity, the method further comprising increasing the fan output as the air temperature increases.

10. The method of claim 7, further comprising;

determining an initial fan start-up voltage for driving the fan at the reduced output;

monitoring an air temperature within the housing; and increasing a voltage for driving the fan as a function of the air temperature inside the housing.

* * * * *